United States Patent [19]

Landsberger

[11] Patent Number: 4,638,514

[45] Date of Patent: Jan. 27, 1987

[54] RAISED SUPERIMPOSED TOILET SEAT AND BIDET-LIKE DEVICE IN COMBINATION

[76] Inventor: Kurt Landsberger, 103 Harrison St., Verona, N.J. 07044

[21] Appl. No.: 842,938

[22] Filed: Mar. 24, 1986

[51] Int. Cl.[4] ..... A47K 13/00; A61H 35/00; E03D 9/08

[52] U.S. Cl. ..... 4/239; 4/235; 4/420.1; 4/420.4; 4/447; 4/448

[58] Field of Search ..... 4/239, 443, 447, 448, 4/234, 235, 237, 661, 483, 420.2, 420.1, 420.4; 297/216, 310, 250, 253, 234, 232, 257, 252

[56] References Cited

U.S. PATENT DOCUMENTS

| | | | |
|---|---|---|---|
| D. 190,408 | 5/1961 | Finlof | 4/239 X |
| D. 237,887 | 12/1975 | Landsberger | D23/71 |
| D. 239,715 | 4/1976 | Finlof | 4/239 X |
| D. 242,457 | 11/1976 | Landsberger | 4/239 X |
| 4,031,575 | 6/1977 | Landsberger | 4/239 |
| 4,069,519 | 1/1978 | Alexander | 4/447 |
| 4,205,402 | 6/1980 | Miller | 4/447 |
| 4,327,451 | 5/1982 | Baus | 4/420.2 |
| 4,383,339 | 5/1983 | Miller | 4/448 |
| 4,477,932 | 10/1984 | Lenosky | 4/234 |

*Primary Examiner*—Henry K. Artis
*Attorney, Agent, or Firm*—Anthony F. Cuoco

[57] ABSTRACT

A raised superimposed toilet seat and bidet-like device in combination is disclosed, wherein the raised seat is superimposed on the bowl of a conventional toilet and the bidet-like device is arranged in a clearance channel on the underside of the seat, and is displaceable from a non-use to a use position for providing a cleansing action for sanitary or healing purposes, as the case may be.

10 Claims, 3 Drawing Figures

RAISED SUPERIMPOSED TOILET SEAT AND BIDET-LIKE DEVICE IN COMBINATION

BACKGROUND OF THE INVENTION

Raised toilet seats which are superimposed upon conventional toilets are an indispensable aid for invalids and others who experience difficulty in sitting on and raising from a conventional toilet seat. The raised superimposed toilet seat is disposed directly on the bowl of a conventional toilet and offers complete comfort to the user, as is desired. Raised superimposed toilet seats of the type contemplated are manufactured by Maddak, Inc., Pequannock, N.J. under the registered trademark TALL-ETTE. These toilet seats are described, for example, in U.S. Design Pat. Nos. 237,887 and 242,457 issued to Kurt Landsberger, the present inventor on Dec. 2, 1975 and Nov. 23, 1976, respectively, and their use in connection with a conventional toilet is described, for example, in U.S. Pat. No. 4,477,932 issued to John Broeils on Oct. 23, 1984 and assigned to Maddak, Inc., Pequannock, N.J.

While raised superimposed toilet seats of the type described have been useful for the purposes intended, it has been found that their use could be well expanded by providing, in combination with the seats, a sanitary cleansing or bidet-like device, whereby those finding need for such seats could easily cleanse the anal or genital areas of the body, as the case may be. Further, it has been found that raised superimposed toilet seats and bidet-like devices, in combination, are useful in post-operative therapy for example, wherein liquid flowing from the bidet is used not only for cleansing, but for healing purposes as well, by those recovering from surgery or the like on the affected bodily areas.

Accordingly, it is the object of the present invention to provide, in combination, a raised superimposed toilet seat and bidet-like device for use by the handicapped or the infirm as a sanitary cleansing device, and/or a therapeutic device for aiding in healing of the affected bodily areas, as the case may be.

SUMMARY OF THE INVENTION

This invention contemplates a raised superimposed toilet seat and bidet-like device in combination, wherein the raised superimposed toilet seat includes a channel disposed on the underside of the seat for receiving a sanitary cleansing or bidet-like device which is supported therein for displacement in a plane parallel to the plane of the seat. The bidet-like device is arranged with the channel so that it is displaceable from a non-use to a use position, with a spray nozzle associated with said device supplying a cleansing liquid for the purposes intended.

DETAILED DESCRIPTION OF THE INVENTION

Figure 2:
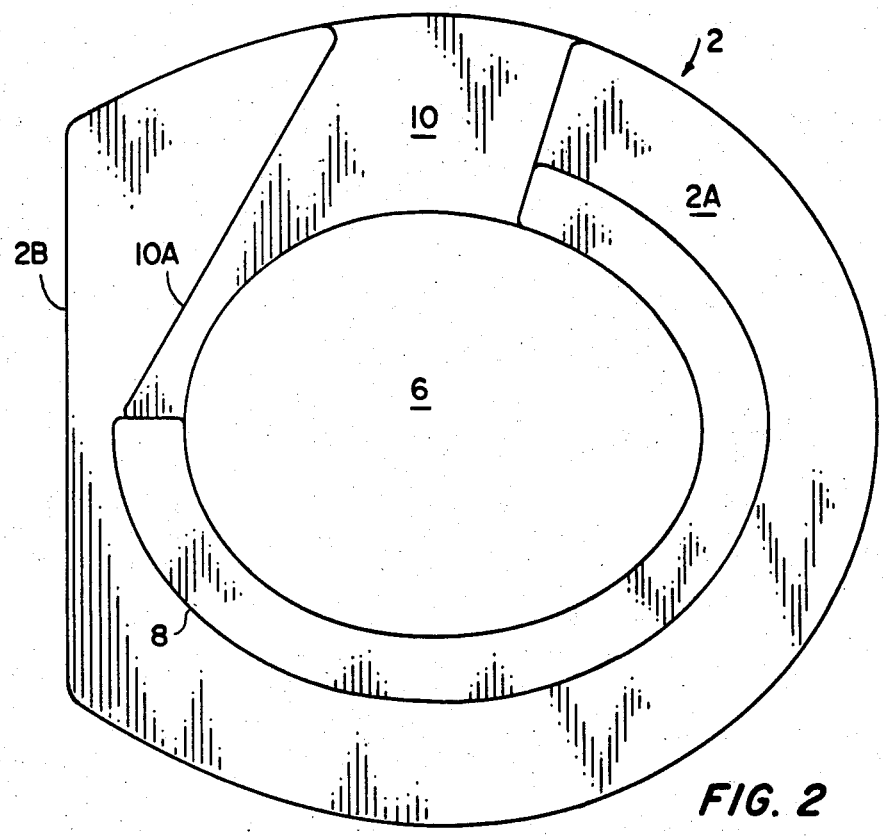
FIG. 2 is a bottom view of the seat.

With reference to the drawing, a raised toilet seat is designated generally by the numeral 2. Raised seat 2 may be of various configurations such as described in the aforenoted U.S. Design Pat. Nos. 237,887 and 242,457, and is shown in its simplest form for purposes of describing the invention. It will therefore suffice to say that a top 4 of raised toilet seat 2 rests on the bowl of a conventional toilet (not otherwise shown). Seat 2 has a through opening 6 disposed substantially central to the seat as best shown in FIGS. 2 and 3.

Seat 2 has a lower portion or rim 8 extending downwardly from the underside 2A of the seat. Rim 8, which is smaller in diameter than top 4 of the seat, fits within the bowl of the conventional toilet, as described in the aforenoted U.S. Pat. No. 4,477,932.

Figure 1:
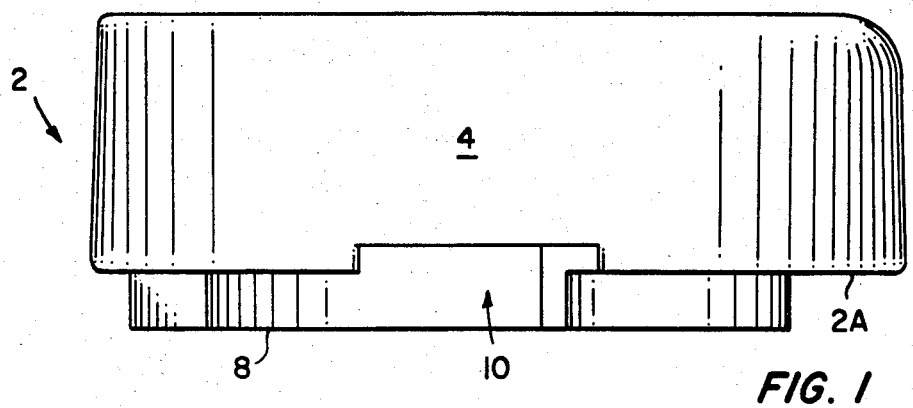
FIG. 1 is a side view showing a raised superimposed toilet seat according to the invention.
Figure 3:
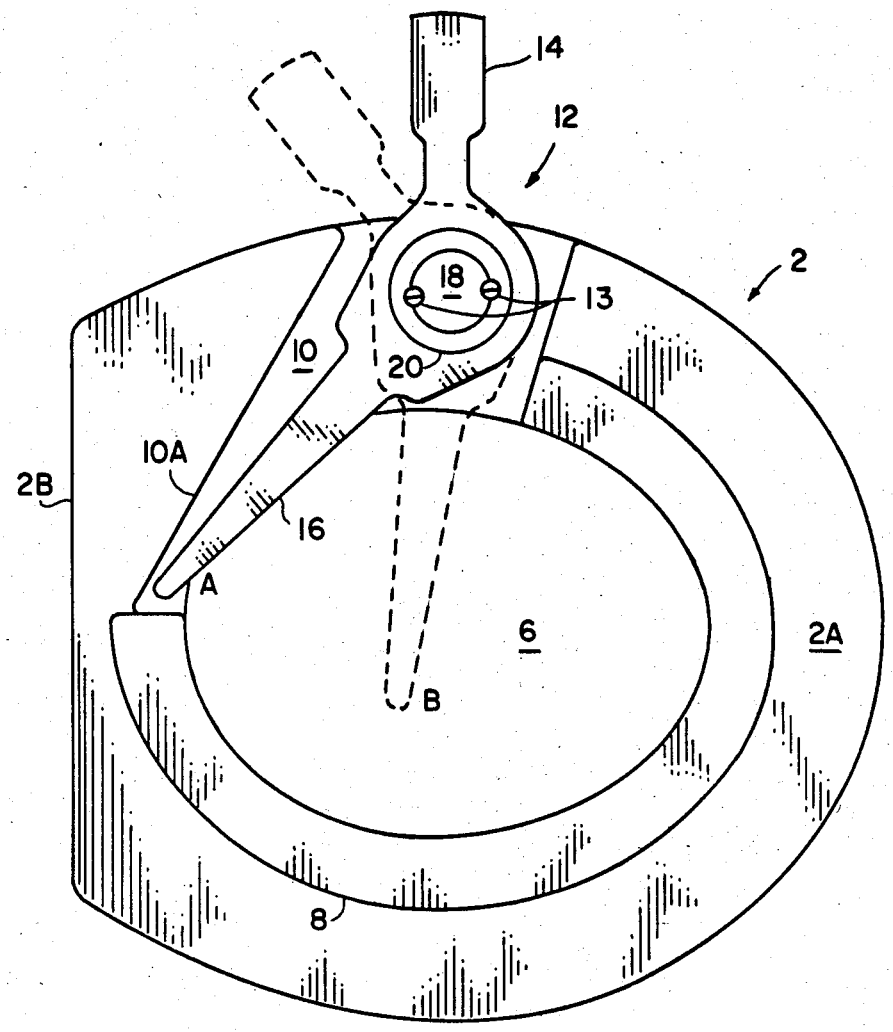
FIG. 3 is a bottom view showing the raised superimposed toilet seat and the bidet-like device in combination, according to the invention.

A channel 10 is provided in underside 2A of seat 2 to accommodate a sanitary cleansing or bidet-like device designated generally by the numeral 12 and shown in FIG. 3. Channel 10 extends angularly from substantially the center of seat 2 toward the back 2B thereof. The channel extends through and interrupts a portion of rim 8 as best shown in FIGS. 2 and 3, and extends into the lower part of seat top 4 and through the side thereof, as best shown in FIG. 1.

Channel 10 provides clearance for the rotational displacement of bidet-like device 12 in a plane parallel to the plane of seat 2 from a non-use position A shown in FIG. 3 near back 2B of seat 2 to a use position B near the center of seat opening 6 as shown in phantom in FIG. 3, said rotational displacement to be hereinafter more fully described.

Bidet-like device 12 is a device of the type which is attached by a pair of screws 13 to bottom 2A of seat 2 within channel 10 as shown in FIG. 3. Displacement of a handle 14 extending through the side of seat 2 causes an elongated spray arm 16 to move in an arc from the aforenoted non-use position A to use position B. A valve (not otherwise shown) is arranged with handle 14, whereby a connection to conventional plumbing or a cleansing liquid reservoir is provided.

Device 12 may be of the type described in U.S. Pat. No. 4,069,519 issued on Jan. 24, 1978 to Dale W. Alexander, and only as much of said device will be described herein as is necessary to understand the invention.

Thus, device 12 includes a circular mounting disc 18 which is secured within channel 10 to the underside of the toilet seat by screws 13. The disc rotatably supports a ring-like body 20 having handle 14 and elongated spray nozzle 16 extending therefrom as shown in FIG. 3. Actuation of handle 14 by the user of the seat, or by another, as the case may be, is effective for swinging or rotating elongated nozzle 16 from non-use position A within channel 10 to use position B near the center of seat hole 6. Passage means for a cleansing liquid are provided in handle 14, disc 18 and spray nozzle 16 which includes flexible conduit means, and handle 14 may have an on-off valve (not otherwise shown) for transmitting liquid, the same being more completely described in the aforenoted U.S. Pat. No. 4,069,519, said description being incorporated herein by reference.

In using the invention, seat 2 is disposed on a conventional toilet with rim 8 extending in the bowl thereof. The arrangement is such that device 12 is slightly below underside 2A of seat 2 and is initially in non-use position A. That is to say, spray nozzle 16 of device 12 is near rear edge 10A of channel 10, said rear edge 10A, in turn, being near back 2B of seat 2. It will be understood that channel 10 is arranged to provide clearance for the displacement of device 12.

To use the device 12, handle 14 is displaced, whereby nozzle 16 swings or rotates in an arc in a plane parallel to the plane of seat 2 to use position B, with the cleansing action provided by the device being thereafter implemented via the aforenoted on-off valve means.

As described in the aforenoted U.S. Pat. No. 4,069,519, device 12 includes appropriate limiting means for limiting the displacement of handle 14 and ring body 20 whereby the ring body rotates within prescribed limits and is locked through detent means or the like in either non-use position A or use position B, as the case may be.

In accordance with the aforegoing description of the invention, a raised superimposed toilet seat and bidet-like device have been provided in combination, whereby the raised seat is superimposed on the bowl of a conventional toilet and the bidet-like device is arranged in a clearance channel on the underside of the seat and rotatable from a non-use position to a use position for providing a cleansing action for sanitary or healing purposes as the case may be.

The arrangement described maximizes user comfort and thus enhances the use of raised superimposed toilet seats by elderly persons or others who suffer immobilizing infirmities to the extent that they are unable to use conventional toilet seats, and provides means for the sanitary or therapeutic action provided as aforenoted.

With the aforegoing description of the invention in mind, reference is had to the appended claims which define the scope of the invention.

What is claimed is:

1. For use with a toilet of the type having a bowl, a raised superimposed toilet seat and bidet-like device in combination, characterized by:

the raised seat including an upper portion which rests on the bowl, a lower portion which fits into the bowl, a hole extending through the upper and lower portions, an underside and a back;

a channel disposed on the underside of the raised seat and extending through a side of said seat;

the bidet-like device supported in the channel for displacement in a plane parallel to the plane of the seat;

the bidet-like device having a member extending external the channel through the side of the seat and operable for displacing said device; and the channel arranged to provide clearance for the device when said member is operated for displacing the device from a non-use position near the back of the seat to a use position near the center of the hole.

2. The combination described by claim 1, further characterized by:

the channel extending angularly from substantially the center of the seat toward the back thereof; and the channel having an edge near the back of the seat.

3. The combination described by claim 1, further characterized by:

the channel extending through and interrupting the lower portion of the seat, and extending into the lower part of the upper portion of said seat.

4. The combination described by claim 1, further characterized by:

the bidet-like device supported in the channel so that said device is slightly below the underside of the seat.

5. For use with a toilet of the type having a bowl, a raised superimposed toilet seat and bidet-like device in combination, characterized by:

the raised seat including an upper portion which rests on the bowl, a lower portion which fits into the bowl, a hole extending through the upper and lower portions, an underside and a back;

a channel disposed on the underside of the raised seat and extending through a side of said seat, said channel extending through and interrupting the lower portion of the seat and extending into the lower part of the upper portion of said seat;

the bidet-like device supported in the channel for displacement in a plane parallel to the plane of the seat;

the device having a member extending external the channel through the side of the seat and operable for displacing said device; and the channel arranged to provide clearance for the device when the device member is operated for displacing said device from a non-use position near the back of the seat to a use position near the center of the seat.

6. The combination described by claim 2, further characterized by:

the non-use position of the device being near the edge of the channel.

7. The combination described by claim 5, further characterized by:

the device supported in the channel so that said device is slightly below the underside of the seat.

8. The combination described by claim 5, further characterized by:

the channel extending angularly from substantially the center of the seat toward the back thereof; and the channel having an edge near the back of the seat.

9. The combination described by claim 8, further characterized by:

the non-use position of the device being near the edge of the channel.

10. For use with a toilet of the type having a bowl, a raised superimposed toilet seat and bidet-like device in combination, characterized by:

the raised seat including an upper portion which rests on the bowl, a lower portion which fits into the bowl, a hole extending through the upper and lower positions, an underside and a back;

a channel disposed on the underside of the raised seat and extending through a side of said seat, said channel extending through and interrupting the lower portion of the seat and extending into the lower part of the upper portion of said seat;

said channel extending angularly from substantially the center of the seat toward the back thereof and having an edge near the back of said seat;

the bidet-like device supported in the channel slightly below the underside of the seat for displacement in a plane parallel to the plane of the seat;

the bidet-like device having a member extending external the channel through the side of the seat and operable for displacing said device; and the channel arranged to provide clearance for the bidet-like device when the device member is operated for rotating said device from a non-use position near the edge of the channel to a use position near the center of the seat.

* * * * *